US009526928B2

(12) United States Patent
Putzer et al.

(10) Patent No.: US 9,526,928 B2
(45) Date of Patent: Dec. 27, 2016

(54) FALL PROTECTION SYSTEM

(71) Applicants: William D. Putzer, Lafayette, NY (US); Todd Gloo, Manlius, NY (US)

(72) Inventors: William D. Putzer, Lafayette, NY (US); Todd Gloo, Manlius, NY (US)

( * ) Notice: Subject to any disclaimer, the term of this patent is extended or adjusted under 35 U.S.C. 154(b) by 58 days.

(21) Appl. No.: 14/257,186

(22) Filed: Apr. 21, 2014

(65) Prior Publication Data

US 2015/0297921 A1 Oct. 22, 2015

(51) Int. Cl.
*A62B 35/00* (2006.01)
*E06C 7/18* (2006.01)

(52) U.S. Cl.
CPC ..... *A62B 35/0068* (2013.01); *A62B 35/005* (2013.01); *A62B 35/0043* (2013.01); *E06C 7/188* (2013.01); *Y10T 29/49947* (2015.01); *Y10T 29/49948* (2015.01)

(58) Field of Classification Search
CPC ..... A62B 35/00; A62B 35/0043; E06C 7/18; E06C 7/186; E06C 7/187; E06C 7/188; Y10T 29/49947; Y10T 29/49948
USPC ..... 29/525.01, 525.02; 182/3, 117
See application file for complete search history.

(56) References Cited

U.S. PATENT DOCUMENTS 2,272,957 A * 2/1942 Walp ..... E04G 1/32 182/155
2,325,592 A * 7/1943 Degler ..... A47C 4/02 182/182.3
3,388,771 A * 6/1968 Corneliusen ..... E04G 1/34 182/153
4,078,633 A * 3/1978 Fahy ..... E04G 3/26 182/145
4,396,092 A * 8/1983 Thompson ..... E04G 1/24 182/150
4,823,913 A * 4/1989 Riegel, Jr. ..... B25H 1/06 182/182.5
4,941,547 A * 7/1990 Livick ..... E06C 7/16 182/107
D341,664 S * 11/1993 Newkirk ..... D25/68
6,286,624 B1 * 9/2001 Bowles ..... E04G 1/30 182/117
6,662,902 B1 * 12/2003 McGuire ..... E04G 1/30 182/113
7,992,680 B2 * 8/2011 Small ..... A62B 35/0087 182/36
8,292,028 B2 * 10/2012 Wise ..... A62B 35/0075 182/19
8,459,412 B2 * 6/2013 Nickel ..... E04G 1/15 182/141

(Continued)

*Primary Examiner* — Christopher Besler
*Assistant Examiner* — Bayan Salone
(74) *Attorney, Agent, or Firm* — David L. Nocilly; Bond Schoeneck & King, PLLC

(57) ABSTRACT

A fall protection system having two telescoping supports positioned at either end of a job location in combination with conventional ladders. The two supports retain and securely attach to a horizontal support beam that is the anchoring location for a fall protection harness. The two supports may also be laterally interconnected to the two ladders, which may additionally support a conventional walk board via ladder jacks. A user may then use the walk board to perform installations or repairs above the minimum height necessary for fall protection and be secured against a fall by attaching via a harness and strap to the cross-bar.

11 Claims, 6 Drawing Sheets

(56) References Cited

U.S. PATENT DOCUMENTS

| | | | | |
|---|---|---|---|---|
| 8,863,904 | B2 * | 10/2014 | Schlecht | E04G 1/38 182/224 |
| 2006/0196724 | A1 * | 9/2006 | Suterski | E04G 1/30 182/117 |
| 2008/0302603 | A1 * | 12/2008 | Madison | E04G 1/30 182/106 |
| 2012/0031700 | A1 * | 2/2012 | Nichols, Jr. | A62B 35/0068 182/3 |
| 2012/0312633 | A1 * | 12/2012 | Massey | A62B 35/0068 182/3 |
| 2013/0020149 | A1 * | 1/2013 | Wise | A62B 35/0075 182/3 |

* cited by examiner

FALL PROTECTION SYSTEM

BACKGROUND OF THE INVENTION

1. Field of the Invention

The present invention relates to fall protection systems and, more particularly, to a system for securely supporting a user engaged in building repairs and renovations.

2. Description of the Related Art

Falls are the leading cause of worker injuries and fatalities in the construction industry in the United States. Each year, between 150 and 200 workers are killed and more than 100,000 are injured as a result of falls at construction sites, despite numerous federal regulations requiring the use of fall protection systems. For example, the Occupational Safety and Health Administration (OSHA) requires that personal fall arrest systems will, when stopping a fall, limit maximum arresting forces, be rigged such that an employee can neither free fall more than six feet nor contact any lower level, bring an employee to a complete stop and limit maximum deceleration distance to 3½ feet, and have sufficient strength to withstand twice the potential impact energy of a worker free falling a distance of 6 feet or the free fall distance permitted by the system. Many other rules and regulations govern worker safety and must be complied with to reduce worker injuries.

One approach to providing protection when work is being performed on the side of a building, such as during window installation or repair, is to remove the roof ridge cap or sheathing and install an anchorage to the truss or rafter structure underneath as roof sheathing does not provide enough support. This process necessary compromises roof integrity and can lead to future problems, such as leaking roofs and lost roof tiles. In addition, this approach requires that contractors have access to and climb onto the roof to install and remove the anchor system, which is time consuming and may require additional equipment not necessary for the particular job and location.

BRIEF SUMMARY OF THE INVENTION

The present invention comprises a fall protection system that is easily installed and does not involve retrofitting an anchorage to the roof or otherwise compromising roof integrity. Instead, a user deploys two vertical supports positioned at either end of a job location. The two vertical supports, which may be telescoping, are interconnected to a horizontal support beam that is used as the anchoring location for a fall protection harness or arrest system. The two vertical supports may be interconnected to two conventional ladders, which may additionally support a conventional walk board via ladder jacks. A user may then perform installations or repair while standing on the walk board and secured against a fall by attaching to the horizontal support beam. In addition, the horizontal support beam may be used to support a hoist with or without the walk board in position. Thus, the present invention avoids the need for extensive site installation and may be used with conventional ladder work system to provide sufficient fall protection and satisfy government workplace regulations.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
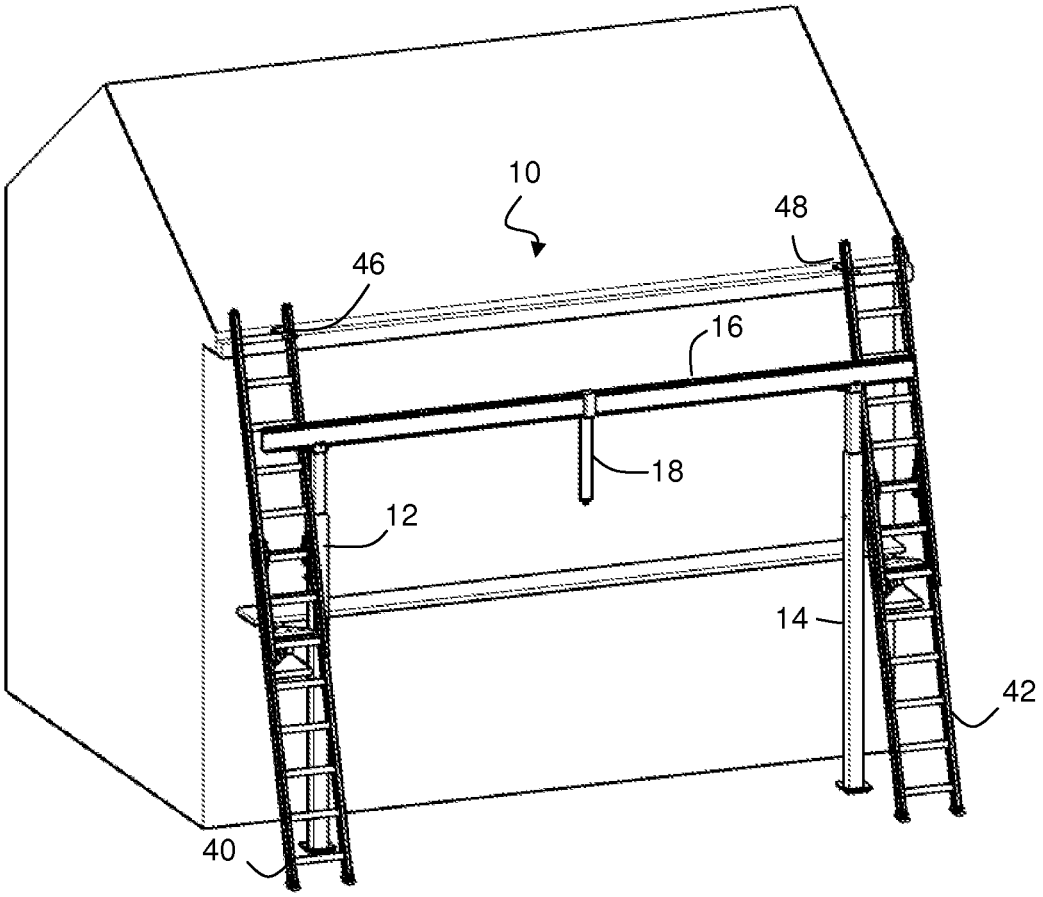
FIG. 1 is a perspective view of a fall protection system according to the present invention.

Referring now to the drawings, wherein like reference numerals refer to like parts throughout, there is seen in FIG. 1 a system 10 for securing a user against falling while performing work on the side of a building, such as installing or replacing windows, repairing siding, etc. System 10 comprises a pair of telescoping supports 12 and 14 that are spaced apart and interconnected a support 16, such as an I-beam, cross-bar, cross-member or the like, the extends horizontally when installed. Horizontal support 16 supports an anchorage 18, as a user-safety strap, wire hook, or cross-arm strap (available from Miller Fall Protection of Honeywell, Inc., Franklin, Pa.), that may be attached to or around horizontal support 16 at one and, at the other end, to a conventional fall protection lanyard and/or harness via a carabiner. Anchorage 18 may alternatively comprise an adjustable beam anchor that is fixed in place, or a beam trolley having rollers that can traverse along an I-beam serving as horizontal support 16.

Figure 2:
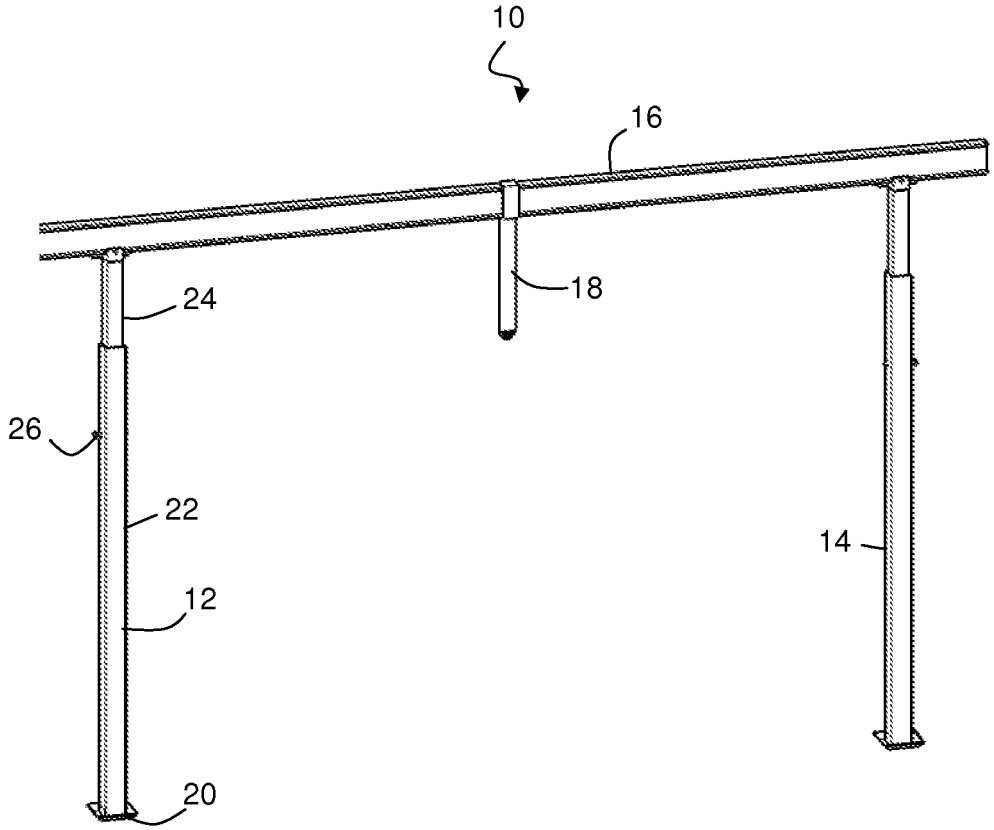
FIG. 2 is a perspective view of a telescoping support for use in a fall protection system according to the present invention.

As seen in FIG. 2, telescoping supports 12 and 14 each include a base 20 for firmly securing supporting 12 and 14 in place next to a building or other structure. Base 20 can include a footer or pad for improved traction, or include holes or other structure that allows base 20 to be pinned, staked, or nailed in place. Base 20 supports a lower member 22 that is telescopically engaged with an upper member 24. Alternatively, lower member 22 and upper member 24 can be integrally formed as a single unit, pivotally attached to each other, or interconnected via fasteners. Lower member 22 preferably comprises a tubular structure that houses upper member 24 is various states between a retracted position and an expended position. Although a retractable pin 26 associated with lower member 22 may be used with a corresponding series of holes 28 in upper member 24 for interlocking lower member 22 and upper member 24 in a fixed position relative to each other, it should be recognized by those of skill in the art that other known mechanisms for securing telescoping elements in place may be used. The composition and dimension of telescoping supports 12 and 14 and horizontal support 16 are preferably selected to comply with current government regulations, such as the fall protection standards of the Occupational Safety and Health Administration (OSHA) that currently require that anchorages for personal fall arrest systems satisfy 5,000 pound tensile load tests.

Figure 3:
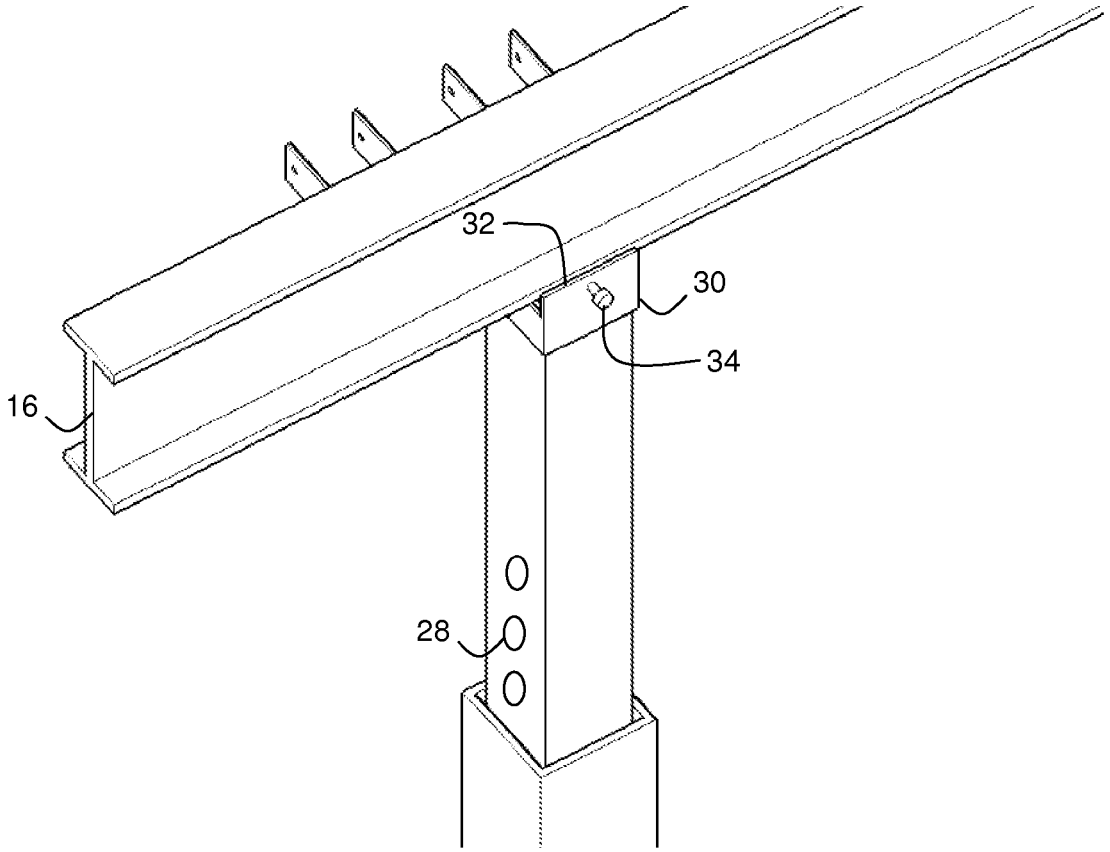
FIG. 3 is a perspective view of an embodiment of a cross-bar interlocking system for use in a fall protection system according to the present invention.

As seen in FIG. 3, the upper end of upper member 24 includes a bracket 30 for locking to cross-bar 16. When horizontal support 16 comprises an I-beam, bracket 30 may comprise a clevis 32 that engages the lower flange of the I-beam. Clevis 32 may optionally include a spring biased pin 34 that extends above the lower flange of the I-beam after it is positioned in clevis 32. It should be recognized by those of skill in the art that upper member 24 may be releasably attached to horizontal support 16 in various ways other than by bracket 30. For example, straps may be used, particularly if horizontal support 16 is rod-shaped, or horizontal support 16 and upper member 24 may interlocked using other known mechanical structures.

Figure 4:
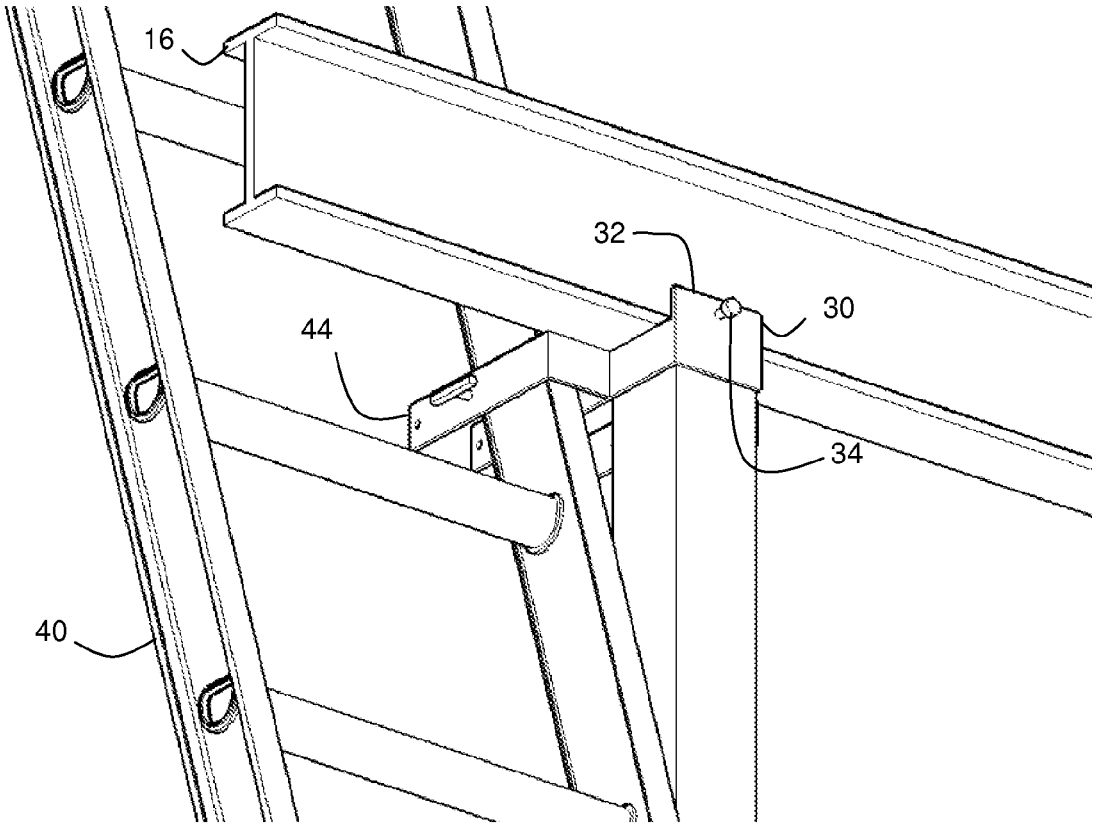
FIG. 4 is a first perspective view of an embodiment of a ladder interlocking system for use in a fall protection system according to the present invention.
Figure 5:
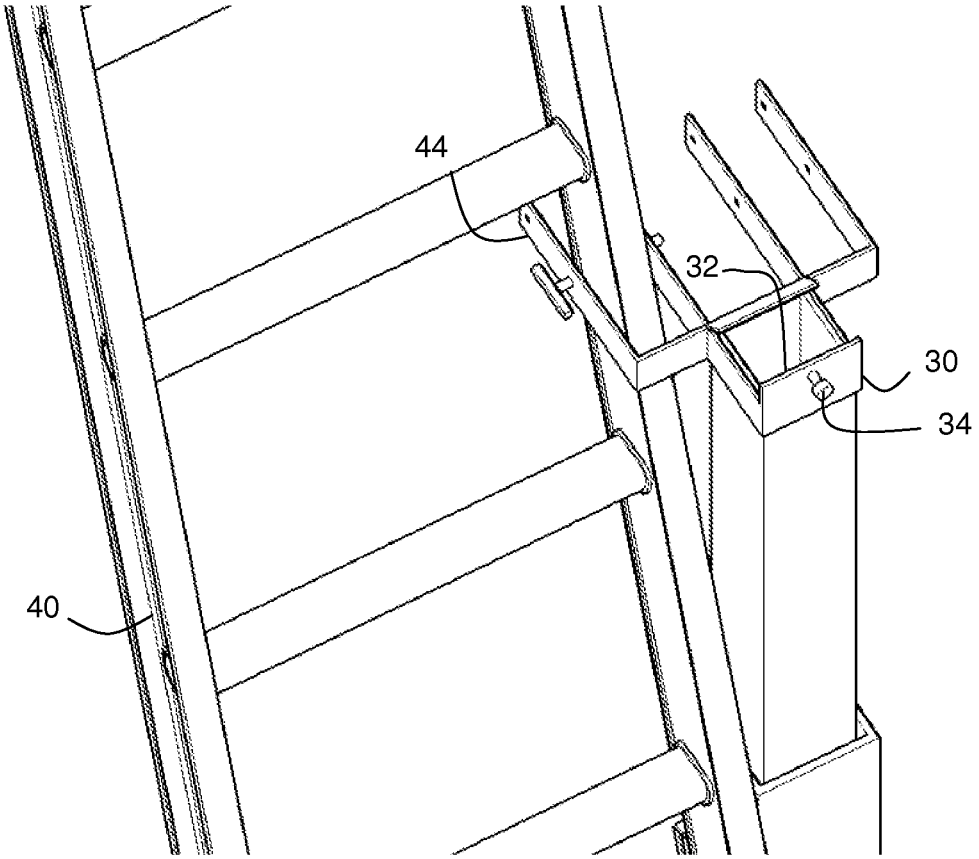
FIG. 5 is a second perspective view of an embodiment of a ladder interlocking system for use in a fall protection system according to the present invention.

Supports 12 and 14 may be secured to corresponding ladders 40 and 42 positioned at either end of the job location. The distance between ladders, and thus the length of horizontal support 16, is dependent on the width of the work area or building and any applicable building codes or government regulations governing occupational safety. For example, OSHA currently allows for various maximum spans depending on the composition of the platform. Supports 12 and 14 may be secured to ladders 40 and 42, respectively, using straps attached to conventional ladder jacks. Alternatively, as seen in FIGS. 4, a ladder bracket 44 dimensioned to engage one of the stringers (or rails) of each of ladder 40 and 42 may be formed with or coupled to bracket 30. As seen in FIG. 5, ladder bracket 44 can be designed to engage a stringer of ladder 40 from either side so that supports 12 and 14 can be positioned interiorly or exteriorly of ladders 40 and 42, or used interchangeable with either of ladders 40 and 42.

As supports 12 and 14 are positioned vertically or at a slight angle away from a building, while properly positioned ladders 40 and 42 will have a standoff angle, ladder bracket 44 may simply engage the stringer of ladders 40 and 42 to prevent movement between supports 12 and 14 and ladders 40 and 42, respectively. In addition, a pair of ladder retainers 46 and 48 may be affixed to the side of the building where work is being performed and attached to the upper ends of ladders 40 and 42 to prevent movement of the ladders laterally or away from the building such as when ladder brackets 44 are used to connect supports 12 and 14 to ladders 40 and 42.

Figure 6:
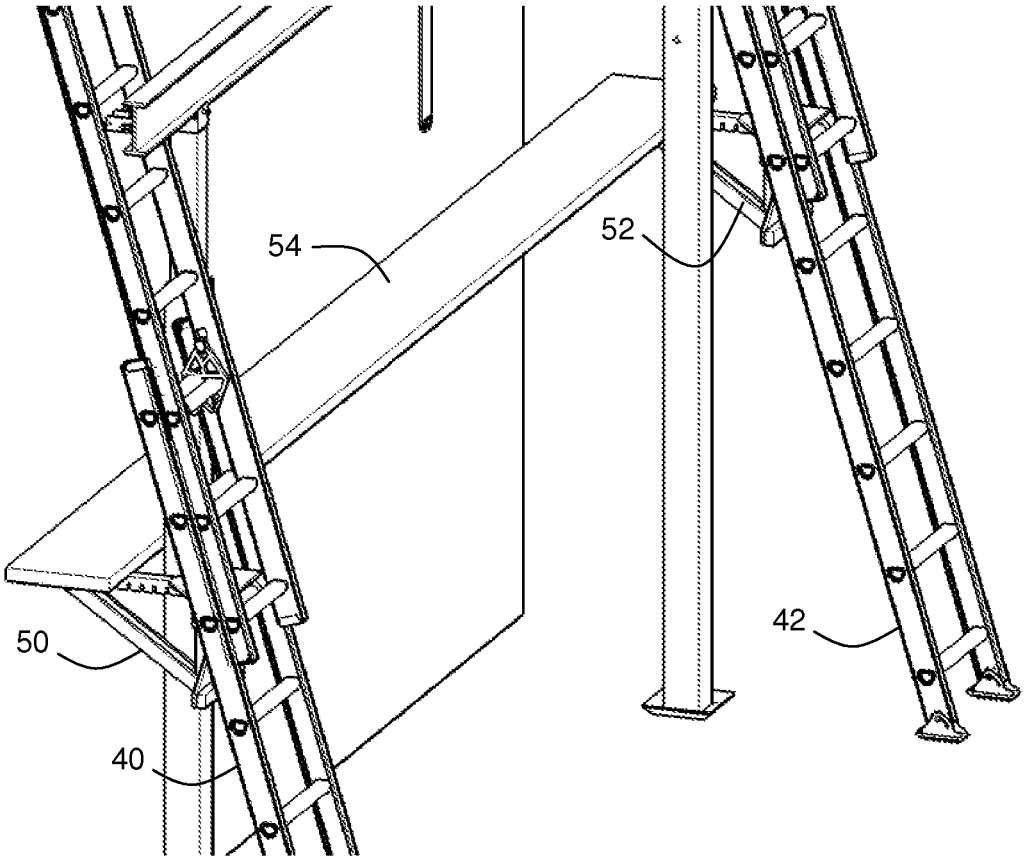
FIG. 6 is a perspective view of the use of a walk-board system in combination with the present invention.

As seen in FIG. 6, a set of ladder jacks 50 and 52 may be positioned on ladders 40 and 42 to support a walk board 54 extending therebetween. A user may thus stand and walk along walk board 54 to perform installations or repairs to the side of a building or structure while harnessed to horizontal support 16. In the event that the user slips off of walk-board 54, horizontal support 16 will prevent user from falling to the ground. Alternatively, horizontal support 16 could additionally be positioned to act as a guard rail in lieu of or in addition to performing the role a fall arrest anchor location.

In addition to using support 16 as the tethering point for a personal arrest system, the present invention may be used as a hoist to lift virtually any heavy item that falls within the safety factors of the system. For example, system 10 may be used to hoist windows so that they may be lifted into position for installation or removed from a location. Similarly, system 10 could be positioned proximately to a garage and used to host vehicle engines, transmissions, and other automotive when performing repairs.

What is claimed is:

1. A fall prevention system, comprising: a pair of telescoping support members, each of which comprises a first section extending along a longitudinal axis and having a base adapted to directly engage ground affixed to a lower end of the first section in alignment with the longitudinal axis, wherein the first section that is telescopically engaged with a second section that terminates in an upper end, wherein the first and second section may be fixed relative to each other to selectively adjust the length of each of said pair of telescoping support members; a pair of brackets mounted to the upper ends of each of said second sections of said pair of support members, wherein each of said brackets includes an upwardly facing clevis and a laterally extending portion adapted to engage a stringer of a ladder: and a cross-bar releasably interconnected to said clevises of said brackets for positioning between an engaged position where said cross-bar may be securely supported in an elevated location by said pair of support members; a disengaged position where said cross-bar is detached from said pair of support members; and positioning a pair of ladders so that each of said pair of ladders is positioned proximately to one of said telescoping supports.

2. The system of claim 1, further comprising a user anchor interconnected to said cross-bar.

3. The system of claim 2, wherein said user anchor is fixedly attached to an intermediate portion of said cross-bar.

4. The system of claim 2, wherein said user anchor is slidingly attached to said cross-bar for movement along said cross-bar.

5. The system of claim 1, wherein said cross-bar comprises an I-beam.

6. The system of claim 1, wherein each of said pair of brackets includes a lock that may be engaged after said I-beam is positioned in said clevis.

7. The system of claim 1, further comprising a second pair of brackets, each of which is positioned on a respective one of said pair of support members, wherein each of said second pair of brackets is configured to securely engage a ladder positioned proximately to each of said support members.

8. The system of claim 7, further comprising a third pair of brackets for attaching a pair of ladders to the side of a structure.

9. A method of providing fall protection, comprising the steps of: providing a pair of telescoping supports, each of which comprises a first section extending along a longitudinal axis with a base adapted to directly engage ground affixed to a lower end of the first section in alignment with the longitudinal axis, wherein the first section is telescopically engaged with a second section: positioning the pair of telescoping supports so that telescoping supports are free standing with the base of each telescoping support engaging the ground and the second sections each of which extends extending upwardly from the ground to form an end having a bracket with an upwardly facing clevis and a laterally extending portion for engaging the stringer of a ladder mounted thereto; positioning said telescoping supports at a predetermined distance apart; telescoping said telescoping supports to a predetermined length and fixing said telescoping members in said predetermined length so that the brackets of the second sections are above a location where a user will be located; affixing a cross-bar having a user anchor to the bracket of each of said telescoping supports; attaching the user to said user anchor; and positioning a pair of ladders so that each of said pair of ladders is positioned proximately to one of said telescoping supports.

10. The method of claim 9, further comprising the step of securing said pair of ladders to the proximately positioned pair of telescoping supports.

11. The method of claim 10, further comprising the step of attaching a walk board to said pair of ladders below said cross-bar.

* * * * *